United States Patent [19]

Harvell

[11] 4,190,918

[45] Mar. 4, 1980

[54] COMBINATION FOLDING CUSHION AND CARRYING ASSEMBLY

[76] Inventor: Glenn M. Harvell, 220 Baggett St., Raleigh, N.C. 27604

[21] Appl. No.: 921,968

[22] Filed: Jul. 5, 1978

[51] Int. Cl.[2] ..... A47G 7/62; A47C 27/00

[52] U.S. Cl. ..... 5/465; 5/466; 5/417; 190/2

[58] Field of Search ..... 297/19, 230, 217, 231, 297/219, 250, 452, 456, DIG. 3; 5/343, 344, 345 R, 352, 357; 150/1, 1.7, 52 R; 190/1, 2, 12, 42

[56] References Cited

U.S. PATENT DOCUMENTS

| | | | |
|---|---|---|---|
| 2,528,768 | 11/1950 | Marsh | 5/465 |
| 3,041,638 | 7/1962 | Lo Vico | 5/419 |
| 3,259,925 | 7/1966 | Tillies | 297/231 |
| 3,659,297 | 5/1972 | Schutz | 5/465 |
| 3,700,278 | 10/1972 | Gulba | 297/217 |

*Primary Examiner*—Casmir A. Nunberg
*Attorney, Agent, or Firm*—Mills & Coats

[57] ABSTRACT

The present invention relates to a hand-carryable folding cushion assembly having two cushions interconnected together by a flexible inner panel and foldable from an extended position to a position where the cushions lie in back-to-back relationship. A pair of attaching panels are secured opposite the flexible inner panel to respective cushions and cooperate to connect and maintain the cushions in back-to-back relationship for convenient carrying. Strap means are secured about the back side of one cushion and adapted to receive and secure a blanket or the like. About the back side of the other cushion is formed a pocket for carrying desirable articles.

7 Claims, 4 Drawing Figures

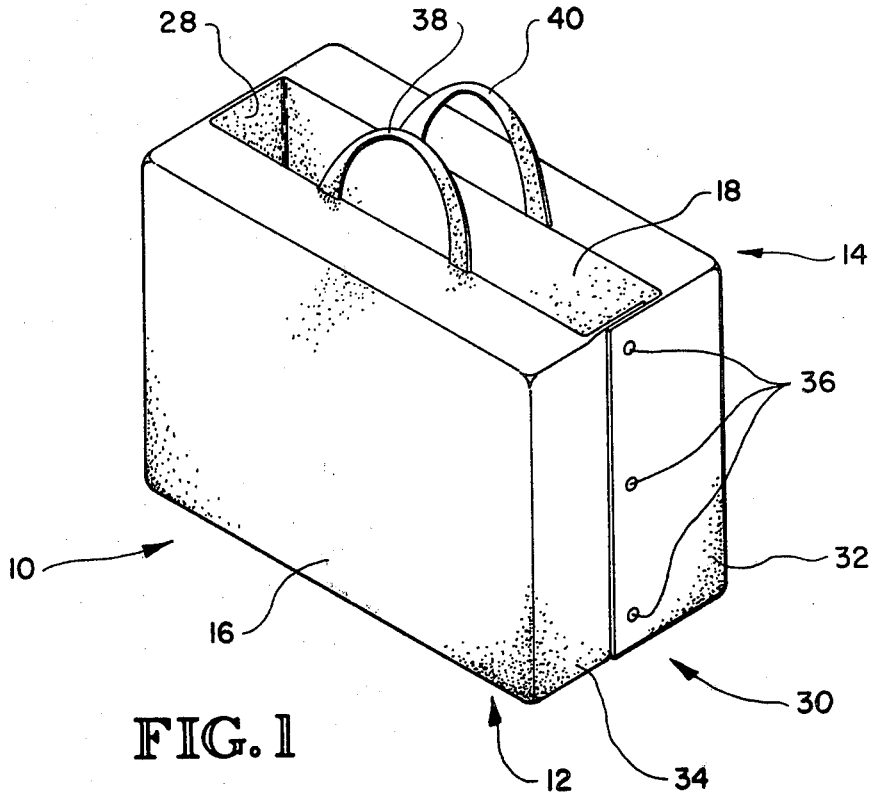
FIG. 1
FIG. 2
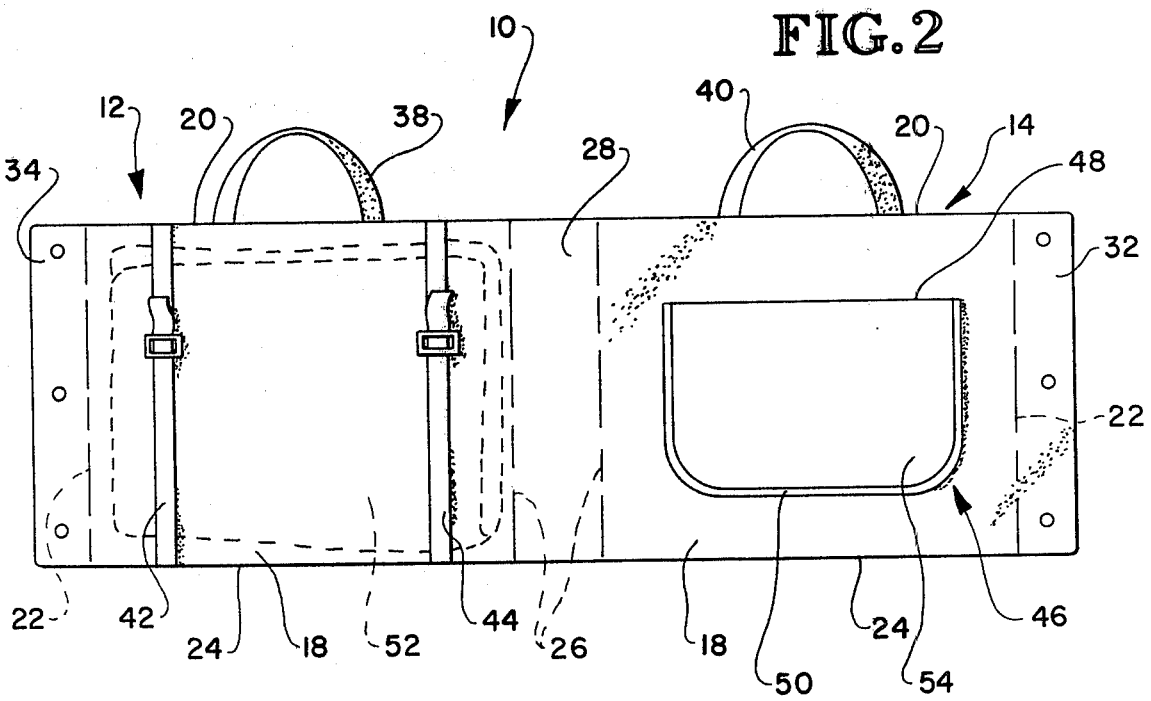

FIG. 3
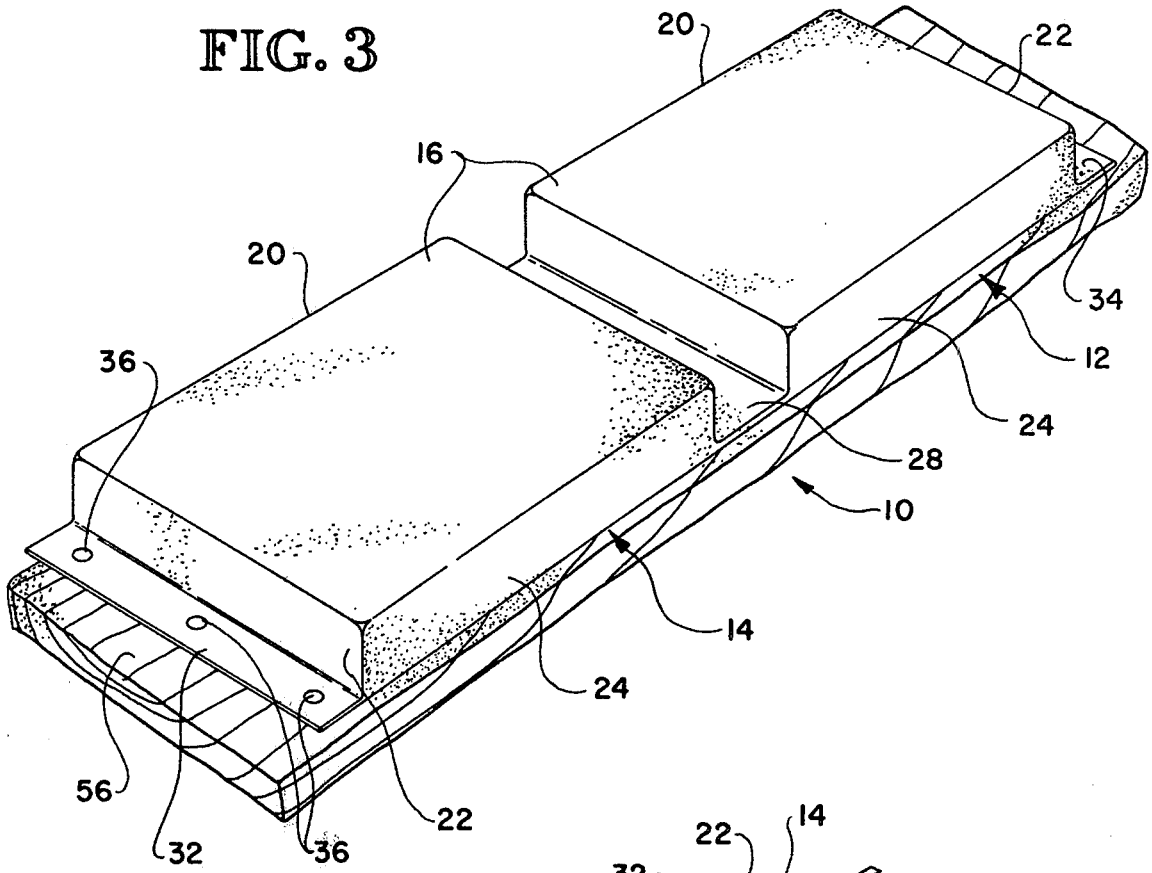
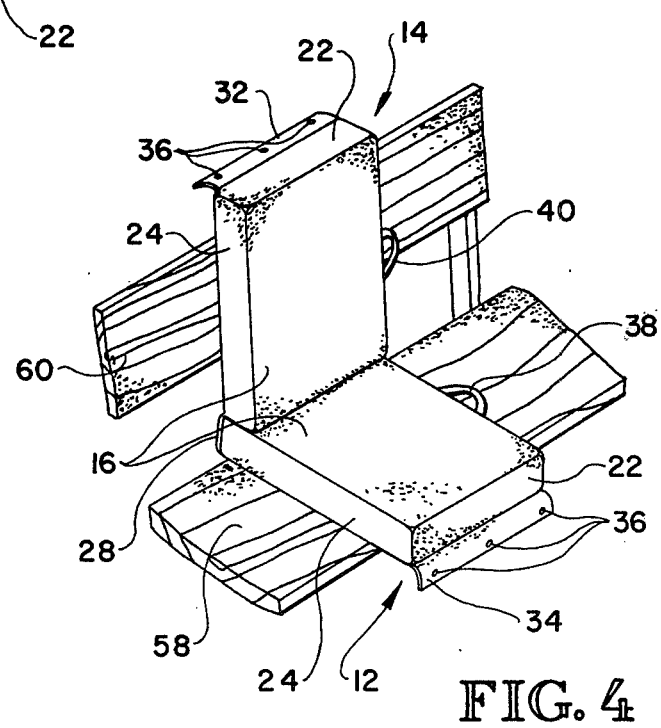
FIG. 4

COMBINATION FOLDING CUSHION AND CARRYING ASSEMBLY

The present invention relates to cushions and seating devices and more particularly to a portable cushion assembly that includes a plurality of cushions and which is foldable for convenient carrying and which is provided with carrying means about the respective back sides of the cushions for carrying desired articles.

BACKGROUND OF INVENTION

Portable cushions are commonly used by people to make bleachers, benches and hard frame seats more comfortable. This is especially true with sport fans that attend outdoor sporting events such as football games and racing events. One example of a typical portable cushion is that shown in U.S. Pat. No. 3,323,151. From a review of this patent, it is seen that the cushion assembly shown therein serves basically only as a cushion or pad device. For outdoor sport events, it is often desirable to carry a blanket, and it is also desirable to carry other articles such as a camera, sunglasses, cosmetics, etc. In carrying a conventional cushion assembly, along with all of the other desired articles, one often finds that such is inconvenient, burdensome, and in fact becomes a substantial chore just to be able to carry all of the desired articles and paraphernalia to the desired destination. Cushion devices such as that shown in U.S. Pat. No. 3,323,151 have not met the need for a comfortable portable cushion assembly having appropriate carrying facilities incorporated therein. Today, there exists a real need for such a device.

SUMMARY OF INVENTION

The present invention is a portable cushion assembly that incorporates means to carry articles including a blanket. More particularly, the portable cushion assembly of the present invention includes two cushions interconnected together by a flexible inner panel and including means for connecting the cushions together when folded in back-to-back relationship. Disposed about the back side of one of said cushions is a strap assembly for receiving and holding a blanket. Formed about the back of the other cushion is a pocket for holding articles. Hand-carrying straps are provided in order that the cushion assembly when folded may be conveniently and easily carried when the cushions are folded and generally surrounding any articles carried and supported by the strap assembly or pocket.

It is, therefore, an object of the present invention to provide a hand-carryable portable cushion assembly that is adapted to support and carry articles such as a blanket and the like.

Another object of the present invention is to provide a portable, hand-carryable cushion assembly with two interconnecting cushions that when extended form two side-by-side cushions adapted to fit on a bench or bleacher, and wherein the two cushions are further foldable to a secured back-to-back relationship for convenient handling and carrying.

Still a further object of the present invention is to provide a portable cushion assembly having two folding cushions adapted to be folded together in back-to-back relationship and provided with carrying means disposed interiorly of the folding cushions for carrying a blanket and other selected articles.

A further object of the present invention is to provide a foldable portable cushion assembly that forms two side-by-side seat cushions or one chair type cushion having both a seat and a back.

Another object of the present invention is to provide a multipurpose cushion assembly that is relatively simple and inexpensive, but yet which is comfortable and easy to handle.

Finally it is an object of the present invention to provide a portable cushion assembly whose utility exceeds that of a cushion per se by incorporating carrying features that enable the portable cushion assembly to be utilized to carry articles in a compact and convenient manner.

Other objects and advantages of the present invention will become apparent from a study of the following description and the accompanying drawings which are merely illustrative of the present invention.

BRIEF DESCRIPTION OF DRAWINGS

FIG. 1 is a perspective view of the folding cushion and carrying assembly of the present invention shown in a folded carrying position.

FIG. 2 is a plan view of the back side of the portable folding cushion and carrying assembly of the present invention in an extended position.

FIG. 3 is a perspective view of the portable folding cushion and carrying assembly of the present invention shown in an extended position and disposed about a bench or bleacher.

FIG. 4 is a perspective view of the folding cushion and carrying assembly of the present invention illustrating its use as a chair type cushion with the two cushions functioning as a seat and a back.

DESCRIPTION OF PREFERRED EMBODIMENT

With further reference to the drawings, the portable cushion and carrying assembly is shown therein and indicated generally by the numeral 10. Portable cushion and carrying assembly 10 includes two cushions indicated generally by the numerals 12 and 14, with each cushion including a front side 16, a back side 18 and edges 20, 22, 24 and 26. The cushions 12 and 14 may be conventionally constructed of porous or loosely woven matting or material such as a foam or resilient type of soft packing. Exteriorly the cushion can be covered with vinyl, naugahyde, leather or any other suitable fabric or material. Details of the material and construction will not be dealt with herein because the type of material and construction of the cushions can be of various known materials and conventional types of construction.

In order to give the portable cushion and carrying assembly 10 capability to fold, there is provided an inner flexible panel 28 connected between the two cushions 12 and 14. About the edge of the cushions opposite the inner flexible panel 28, there is provided attaching means indicated generally by the numeral 30 that allows the two cushions 12 and 14 to be attached and secured together in back-to-back relationship. More particularly, the attaching means 30 includes a first panel 32 secured to cushion 12 and a second panel 34 secured to the second cushion 14. First and second panels 32 and 34 are adapted to co-operate, as shown in FIG. 1, to secure the portable cushion and carrying assembly 10 in a folded carrying position. A series of conventional snap fasteners 36 are associated with the first and second panels 32 and 34 in order that one panel can be secured to another.

To provide means for hand-carrying the portable cushion carrying assembly 10, there is provided a pair of hand straps 38 and 40 secured about a top edge portion of the cushions 12 and 14 as indicated in FIG. 1.

With reference to FIG. 2, one particular important feature of the present invention is the provision of carrying means associated with the portable cushion and carrying assembly 10 that permits the same to be used to carry desired articles therein. In this regard, about the back side 18 of cushion 12, there is provided strap means for strapping and securing an article such as a blanket 52 about the back side of that cushion. The strap means being referred to includes a pair of strap sets 42 and 44, with each strap set including two straps secured about opposite edges of the back and including adjustable fastening means for enabling the straps to be tensioned against the blanket or the particular article held thereby.

About the other back side, that is back side 18 of cushion 14 as viewed in FIG. 2, there is provided a pocket 46 for receiving and supporting certain selected articles such as toothpaste, comb, containers, cosmetics, etc. Pocket 46 includes a pocket panel 54 secured to the back side 18 of cushion 14 by a generally U-shaped seam 50. The top of the pocket 46 includes an opening 48 that allows the selected articles to be placed therein.

In use, the folding portable cushion and carrying assembly 10 is shown in FIG. 3 in an extended position and disposed about a bench or bleacher 56. It is thereby seen that in this extended position the portable cushion and carrying assembly 10 is disposed such that the front side or seat portions of cushions 12 and 14 are disposed upright and in side-by-side relationship to accommodate and serve at least two individuals who might want to sit on the bench 56 with the comfort provided by the respective cushions.

In FIG. 4, the folded cushion and carrying assembly 10 is shown in an upright single cushion type seat posture about a bench structure 58 having a back 60. It is seen that cushion 12 becomes a back cushion and cushion 14 becomes the seat cushion and together they form a single unitary seat type cushion assembly. It is, therefore, appreciated that the folding cushion and carrying assembly 10 of the present invention can be utilized in either of the ways illustrated in FIGS. 3 and 4.

Finally, referring to the carrying utility of the portable cushion and carrying assembly 10 of the present invention, it is appreciated that one important design feature in this regard relates to the fact that the carrying facility, particularly the pocket 46 and strap sets 42 and 44, are diposed about the back side 18 of the cushions and are consequently enclosed and housed by the cushion assembly when in the folded carrying position illustrated in FIG. 1.

From the foregoing specification, it is appreciated that the present invention entails a generally simple and relatively inexpensive portable cushion and carrying assembly 10 that not only serves as a cushion when used as suggested in FIGS. 3 and 4, but has the added utility of being designed to carry certain articles such as a blanket 52 that is often desired and needed in conjunction with the cushion use of the invention. Therefore, it can be said that the present invention serves a multipurpose and is particularly adapted and suitable for use for the sports fan that attends outdoor sporting events such as football games and racing events and the like.

The terms "upper", "lower", "forward", "rearward", etc., have been used herein merely for the convenience of the foregoing specification and in the appended Claims to describe the combination folding cushion and carrying assembly and its parts as oriented in the drawings. It is to be understood, however, that these terms are in no way limiting to the invention since the combination folding cushion and carrying assembly may obviously be disposed in many different positions when in actual use.

The present invention, of course, may be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended Claims are intended to be embraced therein.

What is claimed is:

1. A combination folding cushion and carrying assembly comprising: at least two cushions having front and back sides; an inner flexible panel interconnected between said two cushions for allowing said cushions to be folded in back-to-back spaced apart relationship; attaching means associated with said cushions and fastenable for holding said cushions in back-to-back spaced apart relationship so as to define an open area between the back sides of said cushions and said inner panel and said attaching means when fastened for accommodating carryables such as a blanket; blanket retaining means operatively associated about the back side of one cushion and operative to hold and confine a blanket about the back side thereof, said blanket retaining means including strap means supported about the back side of said cushion and extending therefrom and including fastening means for allowing said strap means to be confined and fastened about a blanket; and handle means secured to at least one cushion and extending therefrom for allowing the folded cushion and carrying assembly to be hand-carried.

2. The combination folding cushion and carrying assembly of claim 1 including a pocket compartment formed about the back side of the other cushion so as to generally be confined within said defined open area when said cushions are folded and held in the back-to-back spaced apart relationship.

3. The combination folding cushion and carrying assembly of claim 1 wherein said attaching means includes first and second panels, each secured to a respective cushion opposite said inner flexible panel, and wherein detachable fastening means is associated with said first and second panels that allow the cushions to be attached and securely held together in back-to-back relationship, and wherein when said cushions are open and extended said inner flexible panel includes a width that extends between the two cushions, and wherein the effective width of said first and second panels of said attaching means when fastened is generally equal to the width of said inner panel.

4. The folding cushion and carrying assembly of claim 3 wherein said strap means includes two sets of spaced apart straps, with each set of straps including two separate straps secured about one end to opposite edge portions of said cushion.

5. The folding cushion and carrying assembly of claim 4 wherein said fastening means for attaching said two cushions in back-to-back relationship includes a plurality of spaced apart snap assemblies associated with said first and second panels.

6. The combination folding cushion and carrying assembly of claim 5 including a pocket compartment formed about the back side of the cushion opposite the cushion with said strap means associated therewith.

7. The combination folding cushion and carrying assembly of claim 6 wherein said pocket is of a generally U-shape and includes a seam sewn around the lower side portions thereof and secured to said back side so as to define an open top about said pocket.

* * * * *